US009487925B1

(12) United States Patent
Meriwether et al.

(10) Patent No.: US 9,487,925 B1
(45) Date of Patent: Nov. 8, 2016

(54) PILE GUIDE FOR A FLOATING DOCK

(71) Applicant: MERCO INC., Wellsburg, WV (US)

(72) Inventors: Jon D. Meriwether, Wellsburg, WV (US); Daniel Louis Otto, Wellsburg, WV (US)

(73) Assignee: Merco Inc., Wellsburg, WV (US)

( * ) Notice: Subject to any disclaimer, the term of this patent is extended or adjusted under 35 U.S.C. 154(b) by 0 days.

(21) Appl. No.: 14/954,674

(22) Filed: Nov. 30, 2015

Related U.S. Application Data

(60) Provisional application No. 62/099,808, filed on Jan. 5, 2015.

(51) Int. Cl.
*B63C 1/02* (2006.01)
*E02B 3/06* (2006.01)

(52) U.S. Cl.
CPC ..... *E02B 3/064* (2013.01)

(58) Field of Classification Search
CPC ..... E02B 3/064; B63C 1/02; E02D 13/04
USPC ..... 405/219; 248/346.07, 670
See application file for complete search history.

(56) References Cited

U.S. PATENT DOCUMENTS

| | | | | |
|---|---|---|---|---|
| 4,043,287 | A * | 8/1977 | Shorter, Jr. | E02B 3/064 114/266 |
| 4,070,980 | A * | 1/1978 | Shorter, Jr. | E02B 3/064 114/263 |
| 4,365,675 | A * | 12/1982 | MacKinnon | E02D 13/04 173/105 |
| 4,441,449 | A * | 4/1984 | Biaggi | E01D 15/24 114/263 |
| 6,230,644 | B1 * | 5/2001 | Passen | B63B 3/06 114/263 |
| 2004/0159273 | A1 * | 8/2004 | Rogerson | E02B 3/064 114/230.1 |
| 2011/0274502 | A1 * | 11/2011 | Tibedo | E02B 3/064 405/213 |
| 2014/0326171 | A1 * | 11/2014 | Gutierrez | B63C 1/02 114/263 |

FOREIGN PATENT DOCUMENTS

| | | | | |
|---|---|---|---|---|
| ES | EP 2682336 A1 * | 1/2014 | | B63B 35/38 |
| KR | 100804054 B1 * | 2/2008 | | |
| KR | 101410372 B1 * | 6/2014 | | |

* cited by examiner

*Primary Examiner* — Frederick L Lagman
(74) *Attorney, Agent, or Firm* — Rankin, Hill & Clark LLP

(57) ABSTRACT

A guide to encircle a vertically extending pile and being connectable to a floating dock to allow vertical movement of the floating dock with respect to the encircled pile, which guide comprises a plurality of individual members carrying pile engaging rollers that are releasably assembled into a closed right angle configuration with the members remaining separate and distinct from each other to change the size of the assembled guide.

27 Claims, 8 Drawing Sheets

PILE GUIDE FOR A FLOATING DOCK

CROSS REFERENCES TO RELATED APPLICATIONS

This application claims the benefit of provisional application Ser. No. 62/099,808 filed on Jan. 5, 2015, and entitled, "Pile Guide for a Floating Dock", which application is incorporated by reference herein.

FIELD

The present invention relates to an improvement in a pile guide that is mounted on a floating dock to surround a fixed vertical pile, so the guide allows the dock to move vertically with respect to the fixed pile according to the level of water supporting the dock.

BACKGROUND OF THE INVENTION

Prior art pile guides comprise square structures mounted on the floating dock and surrounding the opening through which the pile protrudes. These prior guides are rectangular, but usually square structures having four pile engaging, horizontal rollers extending outwardly above the top surface of the dock. One or more of these rollers engage the pile as a dock moves vertically. Such prior art pile guides are designed for different size piles from about 10 inches in effective diameter. Each different sized pile has its own pile guide, with a dimension of the pile guide generally conforming to the size of the pile. Consequently, the guide manufacturer must supply different pile guides to installers of floating docks so the guides can accommodate the particular size of piles being used with the particular dock.

SUMMARY OF INVENTION

In accordance with the present invention, the internal pile guide for a vertical pile is provided as a unitary structure that can be adjusted to accommodate different sized piles. Consequently, a single structure can be purchased to accommodate various sized vertical piles extending through an opening or in some instances along the side of a floating dock. In summary, the invention is a universally sized internal pile guide for larger piles, which guide can be fixedly adjusted to various sizes and having a right angled shape, preferably in a square shape.

STATEMENTS OF INVENTION

The preferred embodiment of the present invention includes a guide to encircle a vertically extending pile. This guide is connected to a floating marine dock to allow vertical movement of the floating dock with respect to the encircling pile. The new guide comprises a plurality of individual members joined together into a horizontal structure with a center opening for receiving the pile when the assembled structure is mounted on a floating dock. The first of the individual members includes a horizontal pile engaging first roller facing in a first direction across the opening. The second of the individual members has a horizontal pile engaging second roller facing in the second direction across the opening. The second direction is generally aligned with, but opposite to the first direction so that the first and second rollers are on opposite sides of the pile guide. Furthermore, a third of the individual members has a horizontal third roller facing in a third direction across the opening of the pile guide where the third direction is generally orthogonal to the first and second directions. Directly opposite to the third individual member is a fourth individual member having a horizontal pile engaging fourth roller facing in a fourth direction across the opening wherein the fourth direction is generally aligned with, but opposite to the third direction. In accordance with the invention, a unitary structure includes the first, second, and third individual members of the guide are releasably assembled to each other in a changeable, but "fixed" right angle configuration with the individual members remaining separate and distinct. Consequently, the members can be adjusted to change the size of the guide to match the pile and the opening in the dock.

To facilitate assembly of the individual members into an adjusted size, the invention includes four corner brackets, one on each corner of the fixed right angle configuration. These four corner brackets are releasably joined to the individual members to allow adjustment of the size of the guide to accommodate the different sizes of openings in the dock and different sizes of piles associated therewith. These four separate corner brackets are releasably clamped to the individual members to change the fixed right angle configuration of the assembled, unitary guide.

So far described, the invention has four roller carrying individual members which are changeably fixed into different sizes by using adjustable corner brackets. These individual members are bolted onto one or all four faces of the opening in the dock to surround the pile. In this preferred embodiment, the bolts are horizontal and attach the individual members in a vertical fashion into the vertical side wall of the opening in the dock. In the alternative embodiment of the invention, the first, second, third and fourth members each have a top flange that extends horizontally over the top of the dock. In this embodiment, the individual members of the unitary guide are bolted directly to the top of the dock, as opposed to the vertical side walls of the pile opening in the dock.

The corner brackets, in the preferred embodiment of the present invention, include a body with two perpendicular, vertical plate sections. Each plate section of the individual corner bracket body has vertically spaced horizontal bolt slots. To match these bolt slots, the assembled individual members comprises a vertical plate with vertically spaced openings, preferably bolt openings matching the slots of the corner brackets. Each hole of a member is individually aligned with one of the parallel slots in the corner brackets. In this manner, the slots in the corner brackets are moveable with respect to the aligned opening in the individual members whereby bolts B locks each of the openings into its aligned slot to change the closed right angle configuration of the novel guide assembly.

In accordance with the present invention, the closed fixed right angle configuration of the adjustable guide has size with a length between 10 inches and 20 inches. As an option, the corner brackets and individual members can be permanently "fixed" after the desired adjusted size of the pile guide has been determined by using the invention. These described elements of the invention are sheet metal with stamped openings, etc.

As discussed above, the individual members can be bolted into the inside surface of the opening, as shown in FIG. 1, or bolted on the top of the dock, as shown in FIG. 6. However, after developing the present invention, a further concept evolved wherein the rollers facing the pile is mounted on the four sides of the pile opening. This concept is shown in FIG. 9 and does not involve an assembled unit as in the present invention. An individual guide member is a separate unit having a horizontal roller for engaging the vertically extending fixed pile protruding through a generally four sided rectangular opening in a floating marine dock. The guide members in this instance are a single unit with a first rectangular plate and a second rectangular plate at a right angle to the first plate. The horizontal roller is fixed to the first plate in a position spaced downwardly from the first plate and the second plate has at least two holes for receiving elongated fastener structures to clamp the second plate to the top surface at one side of the four sided rectangular opening in the dock. When using this concept, four of the guide members are clampable to the various sides of the dock opening. In this manner, the four guide members are assembled into fixed right angle configuration with the individual guide members each being units that are separate and distinct. The invention as set forth above, however, involves the novel development of an assembled guide which can be adjusted to match a given pile or dock opening and is advantageous to the concept of FIG. 9.

These and other objects, aspects, features and advantages of the invention will become apparent to those skilled in the art upon a reading of the detailed description of the invention set forth below, taken together with the drawings which will be described in the next section.

BRIEF DESCRIPTION OF THE DRAWINGS

This invention as defined above may take physical form in certain parts and arrangements of parts, preferred embodiment of which will be described in detail in the accompanying drawings, which form a part hereof and wherein.

DESCRIPTION OF PREFERRED EMBODIMENTS

Figure 1:
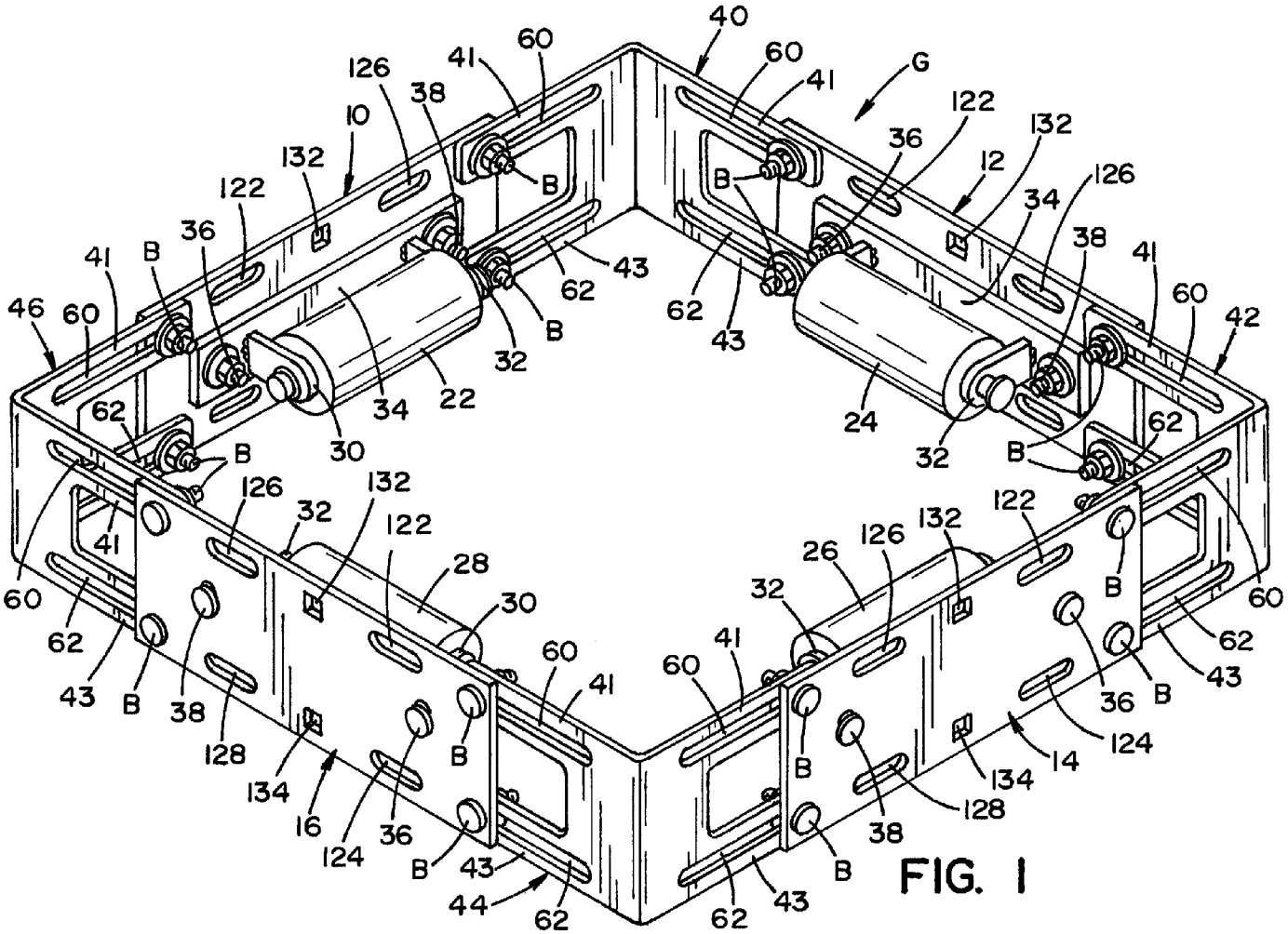
FIG. 1 is a top perspective view of a universally sized large pile guide according to the preferred embodiment of the invention.

Referring now to the drawings, wherein the showings are for the purpose of illustrating a preferred and an alternative embodiment of the invention and not for the purpose of limiting same. It is appreciated that the various disclosed features and other features, functions, alternatives, or varieties may be desirably combined into many other different systems and applications coming within the scope of the disclosed invention as defined in the appended claims. Furthermore, considerable emphasis has been and will be placed on the embodiments of the invention illustrated and described herein. As appreciated that other embodiments and equivalents thereof can be made without departing from the intended scope of the present invention. Many changes can be made in the preferred embodiment without departing from the principals of the invention. The embodiments described herein can be combined to form yet other embodiments of the individual invention. Accordingly it is distinctly understood that the descripting matter is to be interpreted merely as illustrative of the claimed invention, but not as a limitation.

Figure 3:
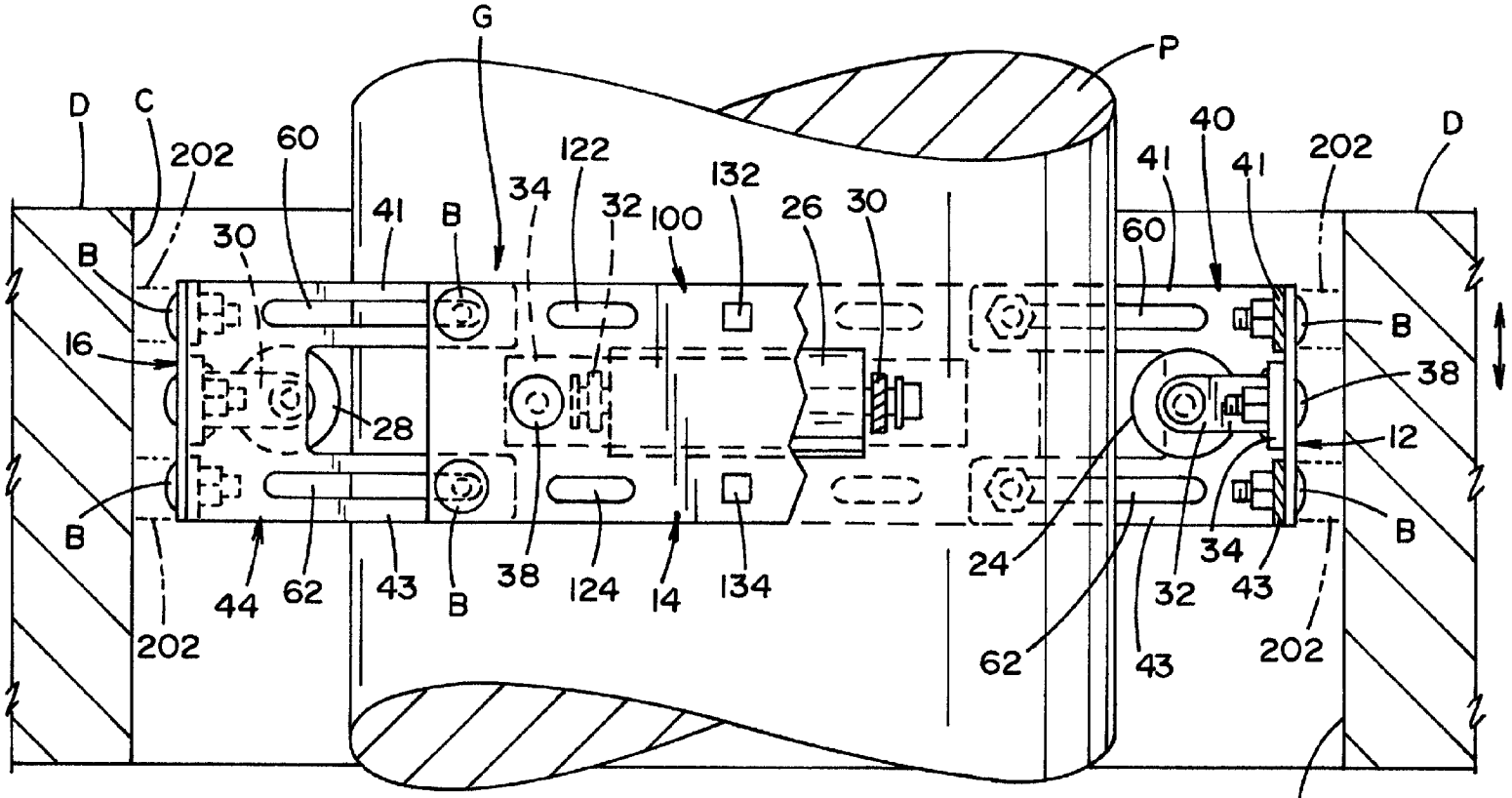
FIG. 3 is partially cross-sectioned view taken along line 3-3 of FIG. 2 of the pile guide shown in FIG. 1 also showing the pile.
Figure 4:
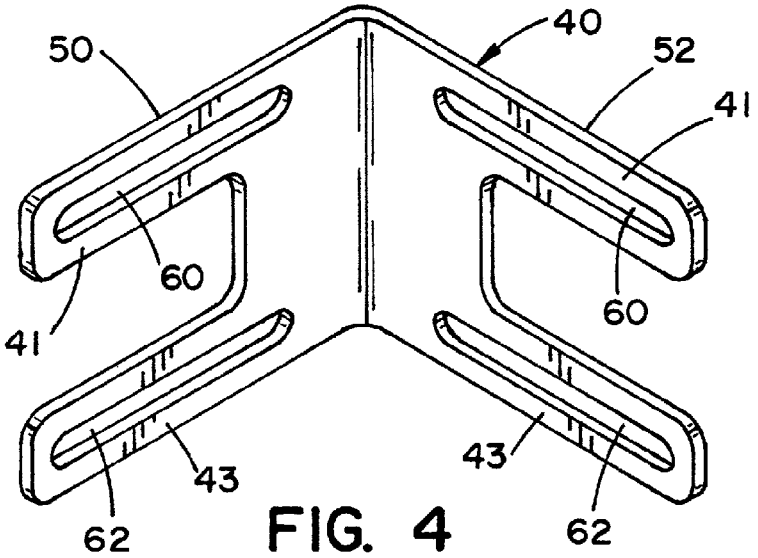
FIG. 4 is a large perspective view of a corner bracket, for which are used in the invention.
Figure 5:
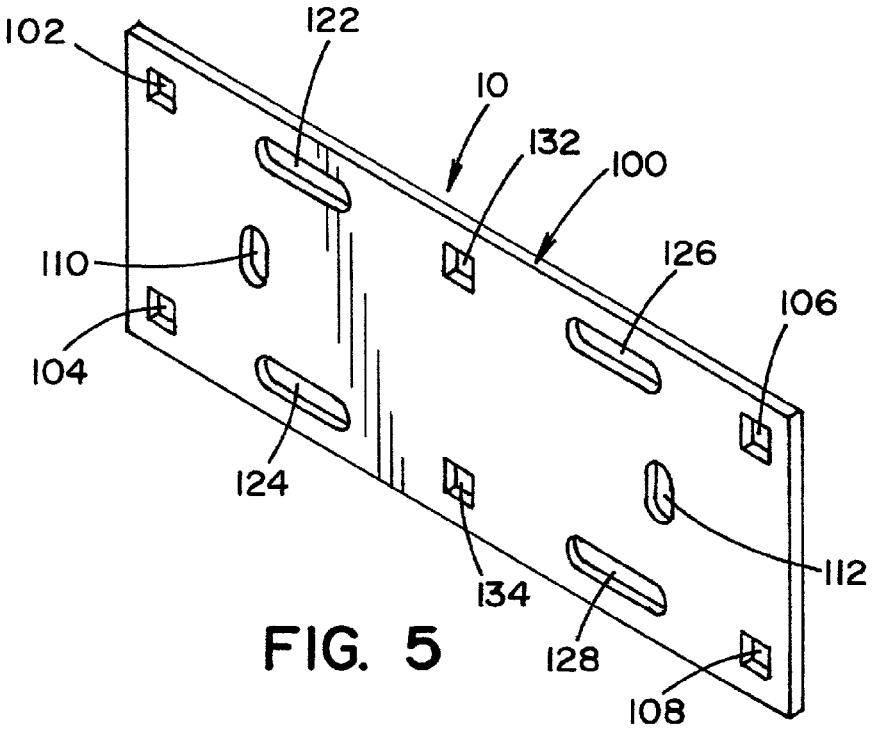
FIG. 5 is a large perspective view of a plate called a "individual member" to support a horizontal roller, for which are used in the assembled guide.

The preferred embodiment of the invention is illustrated in FIGS. 1-5 wherein an assembled internal pile guide G has a changeable size to match a different size of vertical pile P extending through opening C in dock D. Guide G has a rectangular or square horizontal shape to surround pile P and includes four individual members 10, 12, 14, and 16 supporting pile facing and/or engaging rollers 22, 24, 26, and 28, respectively. Each of the supporting rollers are mounted on trunnions 30, 32 fixedly secured to plate 34 and bolted onto the individual members by spaced bolts 36, 38. Thus, there are four rollers mounted at the four sides of guide G so the rollers extend toward and generally engage pile P when the individual members are mounted onto the inner, vertical wall of opening C. In accordance with the invention, there are provided four corner brackets 40, 42, 44, and 46, best shown in FIG. 4, to form guide G into a unitary structure. Each of these corner brackets have vertical plate sections 50, 52 with parallel horizontally spaced bolt slots 60, 62 so that the four corner brackets can cooperate with the four individual members 10, 12, 14, and 16, one of which is illustrated in FIG. 5. Slots 60, 62 are in fingers 41, 43, respectively. This shape saves metal in the stamped metal structure. The four individual members carry supporting rollers 22, 24, 26, and 28 and include a flat vertical plate 100. To adjust the size of guide G, illustrated member 10, as shown in FIG. 5, includes vertically spaced bolt holes 102 and 104 on one end of plate 100 and vertically spaced holes 106 and 108 on the other end of the plate. These bolt holes co-act with horizontal slots 60, 62 of the corner brackets so that these individual members can be clamped into the desired adjusted position by a series of bolts B, as shown in FIG. 1. Consequently, the fixed rectangular shape of assembled guide G can be changed by locking the corner brackets and individual members into the desired positions by a series of bolts B with associated nuts and washers. As explained in the statement of the invention, it is within the scope of the invention to actually fix the position of the individual members and corner brackets after the desired shape of the assembled unit has been determined by adjustment of the parts. For the purpose of mounting trunnions 30, 32 of rollers 22, 24, 26, and 28 onto the individual members 10, 12, 14, and 16, each of the members have mounting slots 110, 112. These slots allow slight vertical adjustment of the rollers. After the plates and corner brackets have been adjusted by fixing bolts B and the rollers have been set by bolts 36, 38, the individual members are fixedly mounted onto the vertical wall defining opening C by structures, such as lag bolts, using either slots 122, 124, 126, and 128 and/or bolt openings 132, 134. Thus, after the shape of guide G is fixed by bolts B, the adjusted guide is then bolted into the inner wall of opening C by bolts indicated as arrows 200 in FIG. 2 and dash lines 202 in FIG. 3. The two functions of adjusting the shape of assembled guide G and mounting the guide G in opening C can be combined.

Figure 2:
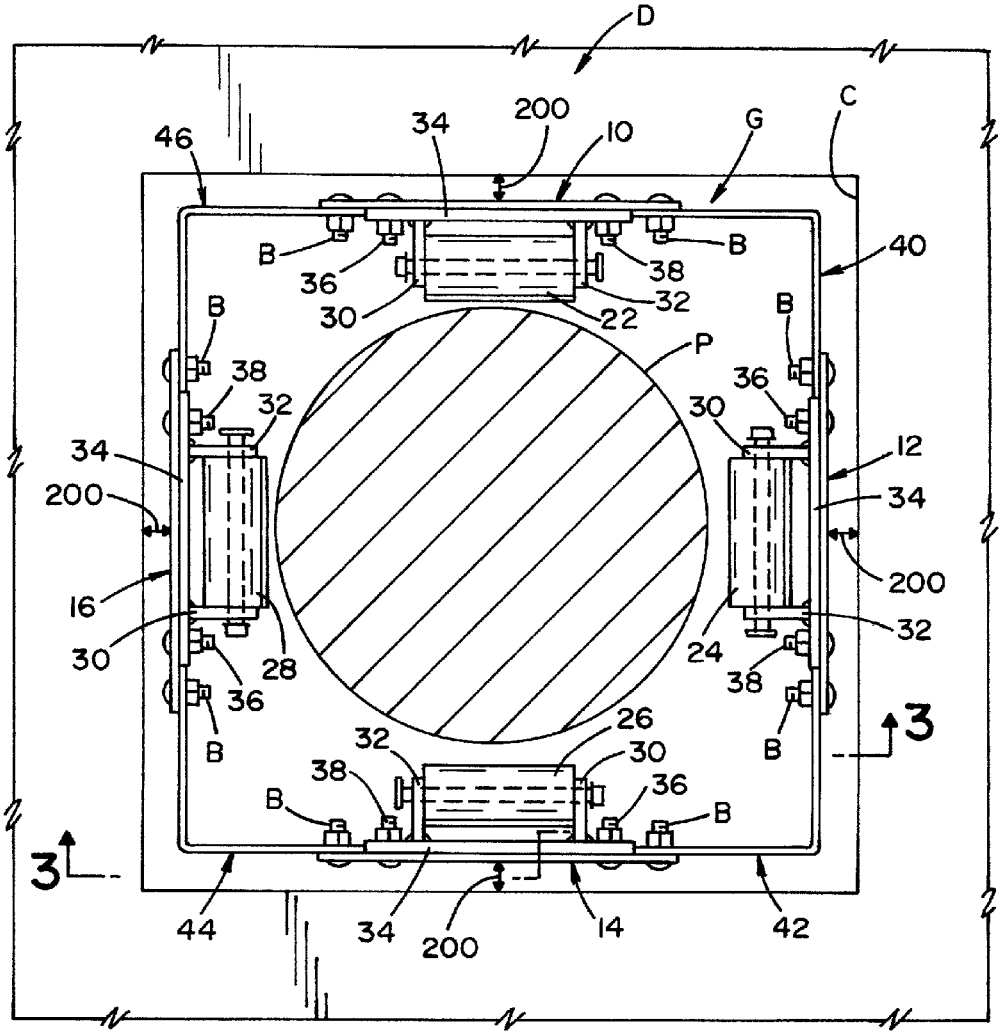
FIG. 2 is a top view of the pile guide shown in FIG. 1 installed around an opening in a dock and it is showing a pile surrounding by the novel pile guide.

By using the invention, guide G is an assembled unit having the shape of four horizontally positioned, pile engaging rollers. These rollers extend directly toward pile P and are not extending upwardly from the top surface of dock D, as in the prior art. Novel internal pile guide G, assembled as shown in FIGS. 1-5, is essentially formed from four "individual members" as illustrated in FIG. 5. These four members are assembled, as shown in FIGS. 1 and 2, to form a changeable right angle structure. These four individual members carry horizontally position, pile engaging rollers and are held together in adjustable size by four corner brackets 40-46, one of which is shown in FIG. 4. The corner brackets have parallel vertically spaced slots 60, 62 that are in vertically spaced fingers 41, 43 respectively. These slots are aligned with openings or slots in the upper and lower portion at one end of the individual members to provide the adjustable feature constituting the primary aspect of the present invention. By adjusting the fixed relationship between the corner brackets and the individual members, the shape and size of assembled pile G is adjusted to accommodate the particular size of the pile extended upwardly through the pile guide to thereby allow vertical movement of dock D with respective pile P. This movement is schematically illustrated in FIG. 3 wherein the adjustable pile guide is in the opening C of dock D with four separate plates assembled with four distinct corner brackets. The assembled guide is "fixed" in an adjustable size or shape.

The pile need not actually engage each of the rollers at all times, but it is generally surrounded by the rollers which are in close proximity thereto. Guide G matches opening C and surrounds pile P so that the guide is adjusted by corner brackets 40-46 and individual members 10-16. The assembled guide is fixedly clamped to the four walls of opening C of dock D. Consequently, the novel pile guide of the present invention is a unit purchased and fixedly adjusted for use with various size piles and openings. Indeed, opening C and the dock is generally cut to match the outside shape of the adjusted pile guide, which guide has a shape generally determined by the size of the pile. The opening is then adjusted to match the guide. These concepts are illustrated generally in FIGS. 2 and 3.

Figure 6:
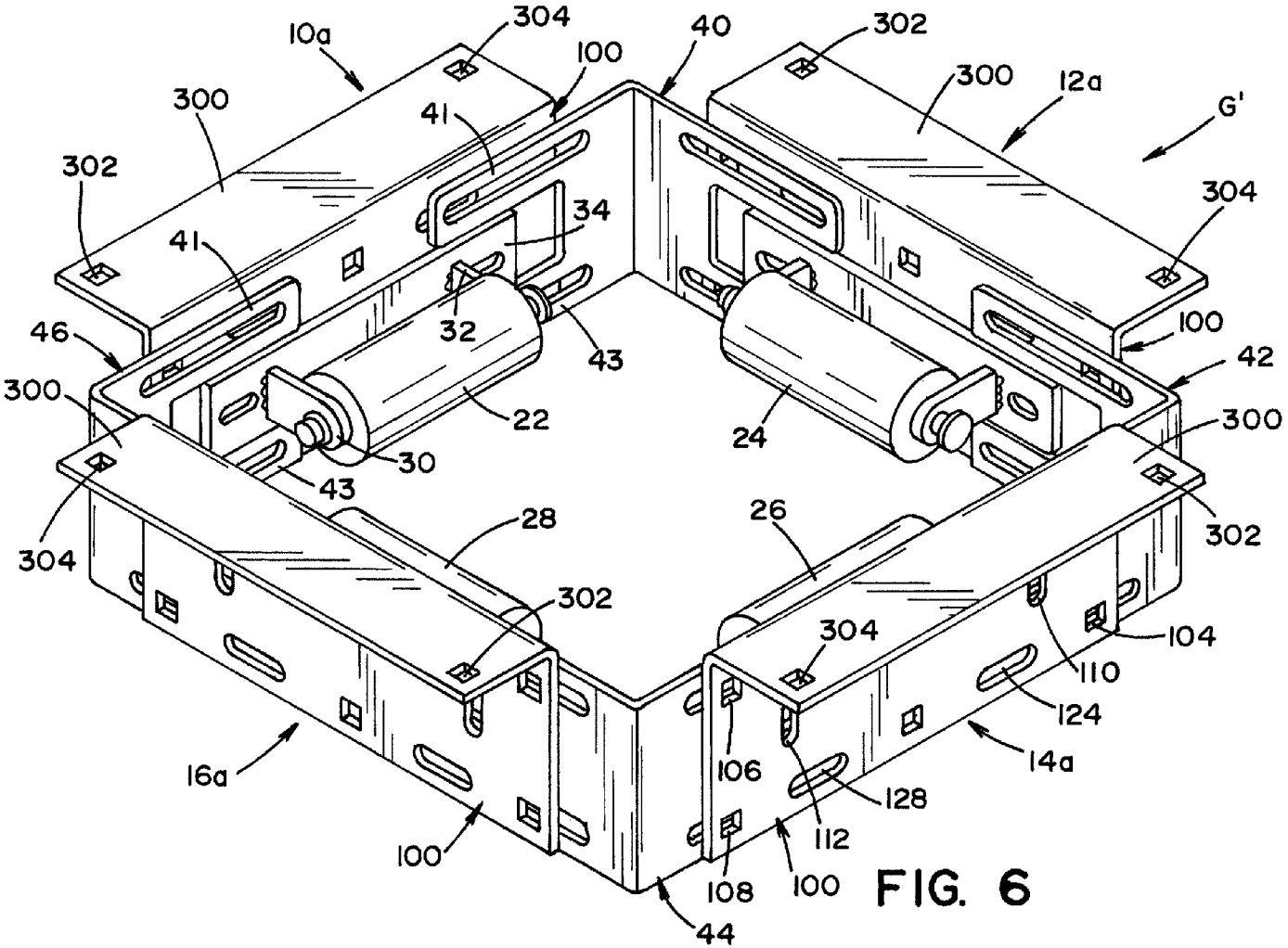
FIG. 6 is a top perspective view of a pile guide according to another embodiment of the invention, where the rollers are still below the surface of the dock, but the guide is mounted on the top surface of the dock.
Figure 7:
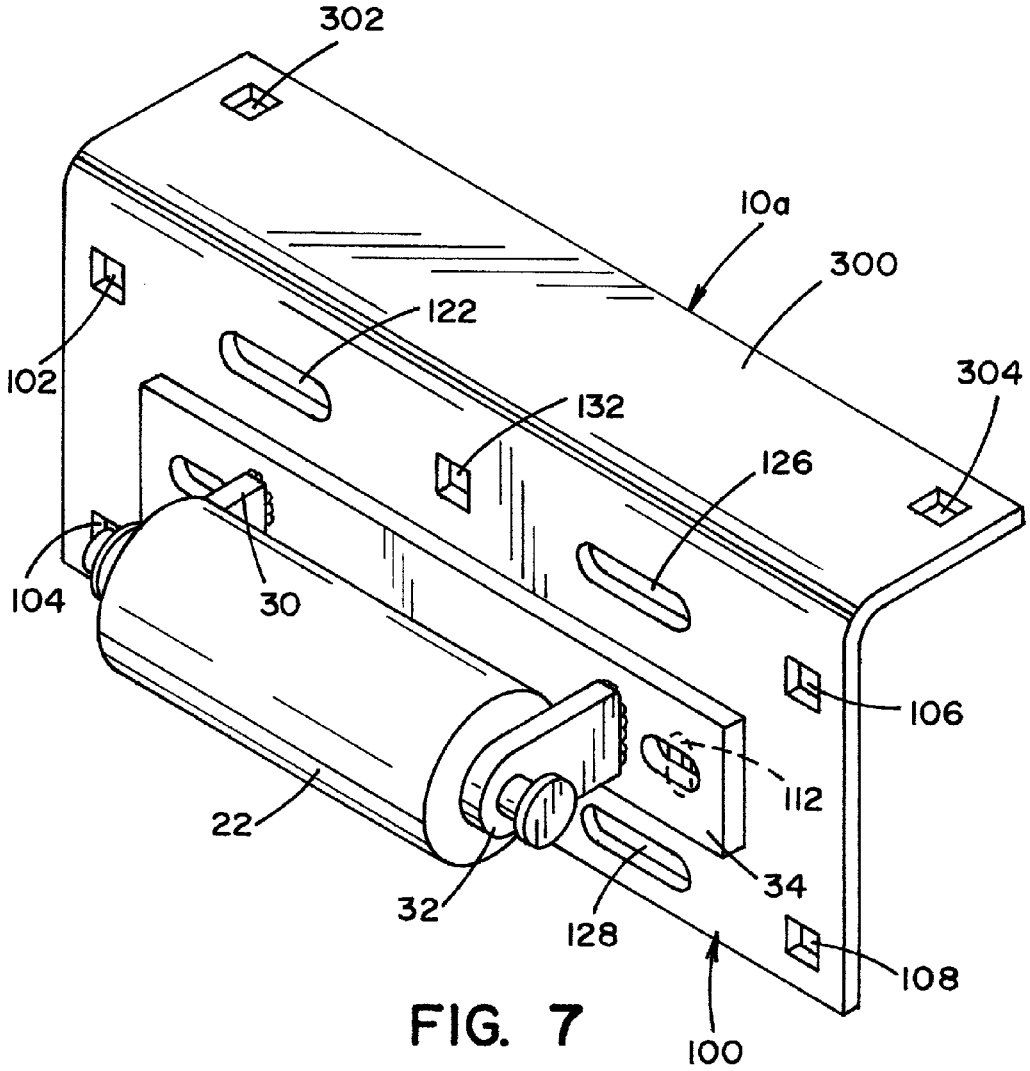
FIG. 7 is a large perspective view of a novel plate for use in the guide of FIG. 6 with a horizontal roller attached thereto.

Referring now to FIGS. 6 and 7, a modification of the preferred embodiment is illustrated wherein the individual members 10-16 are replaced by modified individual members 10*a*, 12*a*, 14*a*, and 16*a*. In this modification, vertical plate 100 is provided with an integral horizontal flange 300 having mounting bolt holes 302, 304. As shown in FIG. 6 modification of the individual members result in a modified pile guide G'. In this pile guide, the individual members are bolted to the top of dock D surrounding opening C. Otherwise, the pile guide is fixedly mounted in a desired right angle configuration as defined and illustrated in the preferred embodiment of the present invention.

The novel, adjustable pile guides of FIGS. 1 and 6 are first "fixedly" assembled into the desired shape and are then fastened to the inside of rectangular opening C surrounding pile P. It is within the scope of the invention to connect the individual members in the assembled guide to match the right angle sides of the rectangular opening through the dock. However, one-three of the individual members need not be connected to the dock. They can merely extend from the dock to encircle a pile adjacent the edge of dock D. Such members can be moved inwardly to be close to the pile thereby fixing the adjusted, size of the guide. Then the members are "fixedly" adjusted, but are not actually connected to their respective sides of the rectangular opening through the dock. Thus, the individual members of the guide are releasably assembled or fixed into a closed right angles configuration on the edge of the dock. This assembly procedure sets the shape of the "configuration" of a guide which shape may not necessarily conform to the actual shape of an opening in the dock; but, it matches the size of the pile. In summary, the individual members are "releasably assembled" into a "fixed" closed right angle configuration. This means that they can be adjusted to change the shape of the right angle configuration to accommodate different size piles within an opening or at the edge of a dock.

Adjustable pile guide normally is fixedly positioned in opening C of dock D; consequently, the adjusted right angle "configuration" generally matches the pile and the shape of dock opening C. Of course, the pile need not be engaged by all four supporting rollers. In some instances the pile is smaller than the adjusted right angle configuration of the guide so that only one or two of the rollers actually contacts the pile. This is generally illustrated in FIG. 2. However, the adjusted fixed angle of the novel pile guide is generally determined by the size of the vertical pile being surrounded by the rollers.

Figure 8:
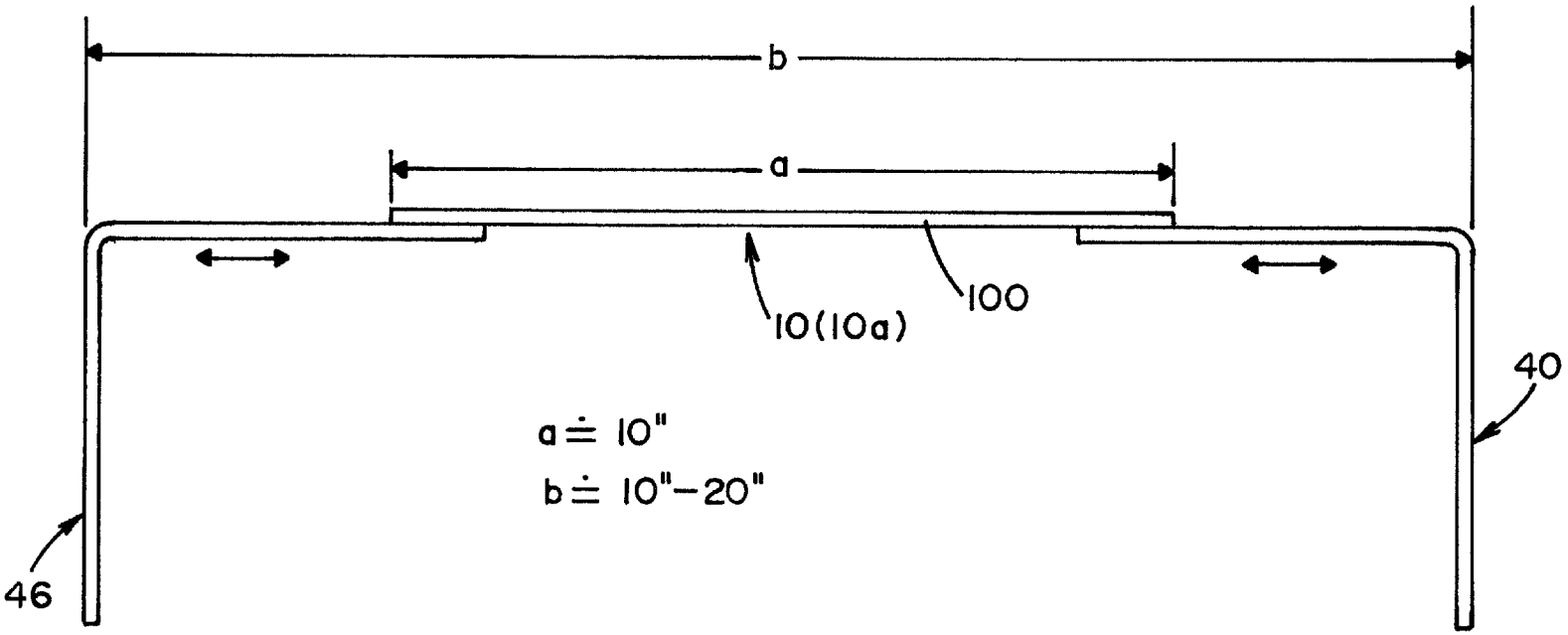
FIG. 8 is a top schematic view of one plate and two corner brackets adjustably connected to the plate with adjusted dimensional features of the novel pile guide shown in FIGS. 1 and 6; and, FIG. 9 is an enlarged perspective view of another concept of a structure to surround a vertical pile.

The invention is used for vertical piles having an effective diameter over about 10 inches. As described above, the "changed" right angle configuration, is shown in FIGS. 2, 3, and 6, and is adjustable into different fixed shapes with dimensions generally described in FIG. 8 with dimensional characteristics. Plate 100 is illustrated in FIG. 8 as the length of individual member 10 or 10*a*. This member has a length a which, in practice, is about 9 to 10 inches. Brackets 40, 46 are adjusted with respect to the individual members or the plates 100 thereof to change the dimension b before the elements are locked together. In practice, dimension a is about 9 to 10 inches. Adjusted dimension b is of the range of 10 inches to 20 inches. The pile engaged in rollers are mounted on the inside of plate 100 by bolts or are permanently attached by a process, such as welding. In the preferred embodiment, the pile engaging rollers which extend downwardly below the upper plane of dock D have a length of about 6 inches. In the adjustable pile guide of the invention, all four rollers are connected to match the size of the dock opening.

Embodiments of the invention as shown in FIGS. 1 and 6 are delivered to the dock site preferably assembled with a size that can be changed, if desired. However, the guide can be shipped already fixed or as eight separate pieces with or without bolts to "fix" the novel internal guide into the desired "changed" right angle configuration.

Figure 9:
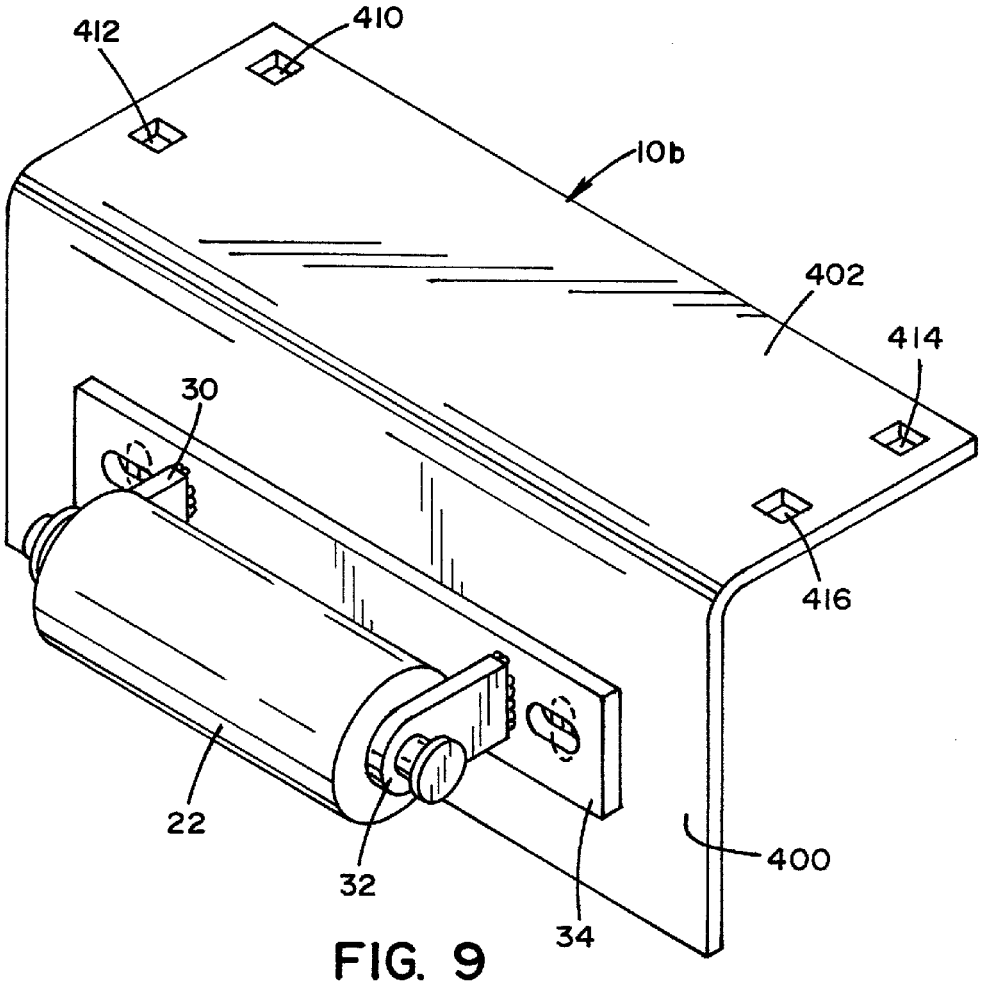

After development of the new internal pile guide for larger piles, another, less advantageous, but new, solution to the problem solved by the invention was realized. This later developed concept is shown in FIG. 9 wherein the separate member 10*b* has a downwardly extending plate 400 having assembled thereon a pile engaging roller assembly 22 carried by trunnions 30, 32 on plate 34. Horizontal plate 402 has openings 410-416 for mounting one of a member 10*b* onto one side of opening C. Separate members are mounted on each side of rectangular opening C to surround vertical pile P. These separate members are positioned on each of the four sides of the rectangular opening C to form a disjointed, non-assembled guide structure which does not constitute an assembled unit with a "fixed" size or shape as in the invention. The use of four separate members 10*b* of FIG. 9 is a "related development." Four members 10*b* are positioned around the four sides of an opening in the dock and are attached to the dock so they surround or encircle a vertical pile. Thus, a pile guide is provided by combining four members 10*b* that are clamped to the four sided opening C. When members 10*b* are assembled, they remain separate and distinct from each other.

SUMMARY

The novel pile guide invention is disclosed and described in a manner well within the skill of any person in this related industry. Other objects, aspects, features, advantages, and developments of the invention will become apparent to those skilled in the art upon reading this detailed description of the invention taken together with the drawings and as defined in the attached claims constituting a part of this description.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

What is claimed is:

1. A guide to encircle a vertically extending pile, said guide being connectable to a floating marine dock to allow vertical movement of said floating dock with respect to said encircled pile, said guide comprising a plurality of individual members joined together into an horizontal structure with a center opening for receiving said pile when said structure is mounted on a floating marine dock: a first of said individual members having an horizontal pile engaging first roller facing in a first direction across said opening; a second of said individual members having an horizontal pile engaging second roller facing in a second direction across said opening, said second direction being generally aligned with, but opposite to, said first direction; a third of said individual members having an horizontal third roller facing in a third direction across said opening, said third direction being generally orthogonal to said first and second directions; and, a fourth of said individual members having an horizontal pile engaging fourth roller facing a fourth direction across said opening, said fourth direction being generally aligned with, but opposite to, said third direction, said first, second, third and fourth individual members of said guide being releasably assembled into a closed right angle configuration having an adjustable horizontal area with said individual members remaining separate and distinct from each other.

2. A guide as defined in claim 1 wherein at least one of said first, second, third and fourth individual members has bolt holes for bolting said member to said dock.

3. A guide as defined in claim 1 wherein at least a majority of said first, second third and fourth individual members each have bolt holes for bolting each of said individual members to said dock.

4. A guide as defined in claim 1 wherein said first, second, third and fourth individual members each have bolt holes for bolting each of said individual members to said dock.

5. A guide as defined in claim 4 wherein said first, second, third, and fourth members each have a flange for extending horizontally over said dock and said bolt holes being in said flange.

6. A guide to encircle a vertically extending pile, said guide being connectable to a floating marine dock to allow vertical movement of said floating dock with respect to said encircled pile, said guide comprising a plurality of individual members joined together into an horizontal structure with a center opening for receiving said pile when said structure is mounted on a floating marine dock: a first of said individual members having an horizontal pile engaging first roller facing in a first direction across said opening; a second of said individual members having an horizontal pile engaging second roller facing in a second direction across said opening, said second direction being generally aligned with, but opposite to, said first direction; a third of said individual members having an horizontal third roller facing in a third direction across said opening, said third direction being generally orthogonal to said first and second directions; and, a fourth of said individual members having an horizontal pile engaging fourth roller facing a fourth direction across said opening, said fourth direction being generally aligned with, but opposite to, said third direction, said first, second, third and fourth individual members of said guide being releasably assembled into a closed right angle configuration with said individual members remaining separate and distinct from each other, said guide includes a first corner bracket releasably joining said first and fourth individual members and a second corner bracket releasably joining said second and fourth individual members.

7. A guide as defined in claim 2 including a third corner bracket releasably joining said first and third individual members and a fourth corner bracket releasably joining said second and third individual members.

8. A guide as defined in claim 3 wherein said corner brackets are releasably clamped to said individual members.

9. A guide as defined in claim 4 wherein said corner brackets are connected to said individual members by bolts.

10. A guide as defined in claim 4 wherein each of said corner brackets include a body with two perpendicular vertical plate sections, each plate section of said bracket body having vertically spaced parallel bolt slots and said individual members joined by each of said corner brackets comprises vertical plates, each plate comprising one of said individual members having vertically spaced openings each of which is individually aligned with one of said parallel slots, with said slots being movable with respect to said aligned openings whereby a bolt can lock each of said openings with its aligned slot to change said closed right angle configuration.

11. A guide as defined in claim 10 wherein said changed closed right angle configuration has sides with a length between 10 inches and 20 inches.

12. A guide as defined in 10 wherein said corner brackets and said individual members are permanently fixed into said changed closed right angle configuration.

13. A guide as defined in claim 3 wherein said corner brackets are connected to said individual members by bolts.

14. A guide as defined in claim 3 wherein each of said corner brackets include a body with two perpendicular vertical plate sections, each plate section of said bracket body having vertically spaced parallel bolt slots and said individual members joined by each of said corner brackets comprises vertical plates, each plate comprising one of said individual members having vertically spaced openings each of which is individually aligned with one of said parallel slots, with said slots being movable with respect to said aligned openings whereby a bolt can lock each of said openings with its aligned slot to change said closed right angle configuration.

15. A guide as defined in claim 14 wherein said changed closed right angle configuration has sides with a length between 10 inches and 20 inches.

16. A guide as defined in 15 wherein said corner brackets and said individual members are permanently fixed into said changed closed right angle configuration.

17. A guide as defined in claim 2 wherein said corner brackets are releasably clamped to said individual members.

18. A guide as defined in claim 5 wherein said corner brackets are connected to said individual members by bolts.

19. A guide as defined in claim 2 wherein said corner brackets are connected to said individual members by bolts.

20. A guide as defined in claim 2 wherein each of said corner brackets include a body with two perpendicular vertical plate sections, each plate section of said bracket body having vertically spaced parallel bolt slots and said individual members joined by each of said corner brackets comprises vertical plates, each plate comprising one of said individual members having vertically spaced openings each of which is individually aligned with one of said parallel slots, with said slots being movable with respect to said aligned openings whereby a bolt can lock each of said openings with its aligned slot to change said closed right angle configuration.

21. A guide as defined in claim 16 wherein said changed closed right angle configuration has sides with a length between 10 inches and 20 inches.

22. A guide as defined in 16 wherein said corner brackets and said individual members are permanently fixed into said changed closed right angle configuration.

23. A guide having first, second, third and fourth guide member releasably assembled into a closed right angle configuration, each of said guide members having a horizontal roller for engaging a vertically extending fixed pile protruding through a generally four sided, rectangular opening in a floating marine dock whereby the dock has a top surface and can move vertically with respect to said fixed pile, said guide member having a first rectangular plate and a second rectangular plate at a right angle to said first plate, said horizontal roller fixed to said first plate in a position spaced downwardly from said second plate and said second plate having at least two holes for receiving elongated fastener structures to clamp said second plate to said top surface at one side of said four sided, rectangular opening with said first of said four guide members being alignable with and clampable to a first side of said four sided opening; said second of said four guide members being alignable with and clampable to a second side of said four sided opening; said third of said four guide members being alignable with and clampable to a third side of said four sided opening; and, said fourth of said four guide members being alignable with and clampable to said fourth side of said four sided opening, and said guide members remaining separate and distinct from each other.

24. A guide as defined in claim 23 including a first corner bracket releasably joining said first and fourth guide members and a second corner bracket releasably joining said second and fourth guide members.

25. A guide as defined in claim 24 including a third corner bracket releasably joining said first and third guide members and a fourth corner bracket releasably joining said second and third guide members.

26. A guide as defined in claim 25 wherein said closed right angle configuration has sides with a length between about 10 inches and 20 inches.

27. A guide as defined in claim 23 wherein said closed right angle configuration has sides with a length between about 10 inches and 20 inches.

* * * * *